US010872720B2

(12) United States Patent
Shimizu et al.

(10) Patent No.: US 10,872,720 B2
(45) Date of Patent: Dec. 22, 2020

(54) ELECTRONIC COMPONENT

(71) Applicant: Murata Manufacturing Co., Ltd., Kyoto-fu (JP)

(72) Inventors: Noriko Shimizu, Nagaokakyo (JP); Kenichi Araki, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 353 days.

(21) Appl. No.: 15/846,287

(22) Filed: Dec. 19, 2017

(65) Prior Publication Data

US 2018/0182537 A1 Jun. 28, 2018

(30) Foreign Application Priority Data

Dec. 27, 2016 (JP) ..... 2016-254112

(51) Int. Cl.
*H01F 27/29* (2006.01)
*H01F 27/24* (2006.01)
*H01F 17/04* (2006.01)

(52) U.S. Cl.
CPC ..... *H01F 27/29* (2013.01); *H01F 17/04* (2013.01); *H01F 27/24* (2013.01); *H01F 27/292* (2013.01); *H01F 2017/046* (2013.01); *H01F 2017/048* (2013.01)

(58) Field of Classification Search
CPC ..... H01F 27/29; H01F 27/292; H01F 17/04; H01F 27/24; H01F 2017/046; H01F 2017/048; H01F 27/55; H01F 27/2823
USPC ..... 336/65, 83, 200, 206–208, 232–234
See application file for complete search history.

(56) References Cited

U.S. PATENT DOCUMENTS

| | | | |
|---|---|---|---|
| 2013/0154780 | A1 | 6/2013 | Yamada et al. |
| 2016/0225521 | A1 | 8/2016 | Yamada |
| 2016/0343501 | A1 | 11/2016 | Suzuki et al. |

FOREIGN PATENT DOCUMENTS

| | | | | |
|---|---|---|---|---|
| CN | 203644518 | U | | 6/2014 |
| JP | H5-326267 | A | | 12/1993 |
| JP | 2000-173835 | A | | 6/2000 |
| JP | 2002305116 | A | | 10/2002 |
| JP | 2013-098282 | A | | 5/2013 |
| JP | 2013098282 | A | * | 5/2013 |
| JP | 2013125896 | A | | 6/2013 |
| JP | 2014-036149 | A | | 2/2014 |
| JP | 2015-046421 | A | | 3/2015 |
| JP | 2015-065284 | A | | 4/2015 |

(Continued)

OTHER PUBLICATIONS

An Office Action mailed by the Chinese Patent Office dated Mar. 11, 2019, which corresponds to Chinese Patent Application No. 201711403321.6 and is related to U.S. Appl. No. 15/846,287; with English language translation.

(Continued)

*Primary Examiner* — Tuyen T Nguyen
(74) *Attorney, Agent, or Firm* — Studebaker & Brackett PC

(57) ABSTRACT

An electronic component includes a body having a recessed portion, an inner conductor embedded in the body, and an outer electrode electrically connected to the inner conductor. At least part of the outer electrode is disposed in the recessed portion of the body. The electronic component further includes an insulating layer configured such that at least part of the outer electrode is covered with the insulating layer.

19 Claims, 4 Drawing Sheets

(56) References Cited

FOREIGN PATENT DOCUMENTS

| | | | | | |
|---|---|---|---|---|---|
| JP | 2015065284 | A | * | 4/2015 | ..... H04G 4/2325 |
| JP | 2016119385 | A | | 6/2016 | |
| JP | 2016143777 | A | | 8/2016 | |
| WO | 2015115318 | A1 | | 8/2015 | |

OTHER PUBLICATIONS

An Office Action; "Notification of Reasons for Refusal," mailed by the Japanese Patent Office dated Feb. 19, 2019, which corresponds to Japanese Patent Application No. 2016-254112 and is related to U.S. Appl. No. 15/846,287; with English language translation.

An Office Action; "Notification of Reasons for Refusal," Mailed by the Japanese Patent Office dated Aug. 6, 2019, which corresponds to Japanese Patent Application No. 2016-254112 and is related to U.S. Appl. No. 15/846,287; with English translation.

* cited by examiner

ELECTRONIC COMPONENT

CROSS-REFERENCE TO RELATED APPLICATION

This application claims benefit of priority to Japanese Patent Application No. 2016-254112, filed Dec. 27, 2016, the entire content of which is incorporated herein by reference.

BACKGROUND

Technical Field

The present disclosure relates to an electronic component and more particularly to an electronic component that includes a body, an inner conductor embedded in the body, and an outer electrode outside the body.

Description of the Related Art

In one known electronic component that includes a body, an inner conductor embedded in the body, and an outer electrode outside the body, the outer electrode is disposed on the surface of the body including the inner conductor, and part of the outer electrode is covered with an insulating layer (Japanese Unexamined Patent Application Publication No. 2015-65284).

In the electronic component described in Japanese Unexamined Patent Application Publication No. 2015-65284, the outer electrode on the surface of the body protrudes from the body. Thus, the size of the electronic component is increased by the thickness of the outer electrode. In recent years, with an increase in the performance and a decrease in the size of electronic equipment, there has been a demand for smaller electronic components for use in electronic equipment. Thus, it is undesirable that the size of an electronic component is increased by an outer electrode, as described above. In order to meet such a demand, the size of the body should be decreased by the thickness of an outer electrode. Thus, it is sometimes impossible to have desired electrical characteristics.

SUMMARY

Accordingly, the present disclosure provides a small electronic component with good electrical characteristics that includes a body including an inner conductor and an outer electrode on the body.

As a result of extensive studies to solve the problems, the present inventor has arrived at the present disclosure by finding that the formation of a recessed portion in a body and the formation of an outer electrode in the recessed portion enable effective utilization of the space occupied by an electronic component, can suppress the electrical characteristic degradation of the electronic component, and can decrease the size of the electronic component.

According to the gist of the present disclosure, there is provided an electronic component that includes a body, an inner conductor embedded in the body, and an outer electrode electrically connected to the inner conductor, wherein the body has a recessed portion, and at least part of the outer electrode is disposed in the recessed portion of the body.

The present disclosure can provide a small electronic component with good electrical characteristics that includes a body including an inner conductor and an outer electrode on the body, wherein a recessed portion is formed on the body, and an outer electrode is formed in the recessed portion.

Other features, elements, characteristics and advantages of the present disclosure will become more apparent from the following detailed description of preferred embodiments of the present disclosure with reference to the attached drawings.

DETAILED DESCRIPTION

Figure 1:
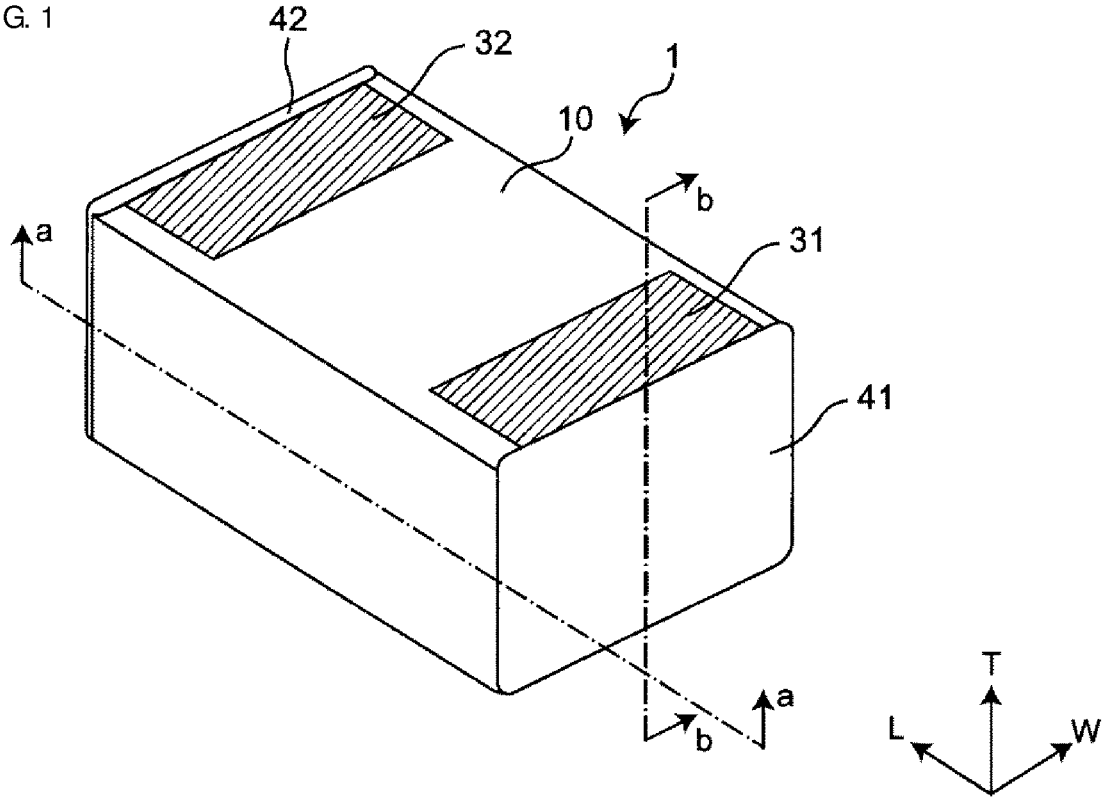
FIG. 1 is a schematic perspective view of an electronic component according to an embodiment of the present disclosure.

Coil components as examples of an electronic component according to the present disclosure will be described in detail below with reference to the accompanying drawings. However, the shape and arrangement of each electronic component and each constituent according to the embodiments are not limited to those illustrated in the drawings.

Figure 2:
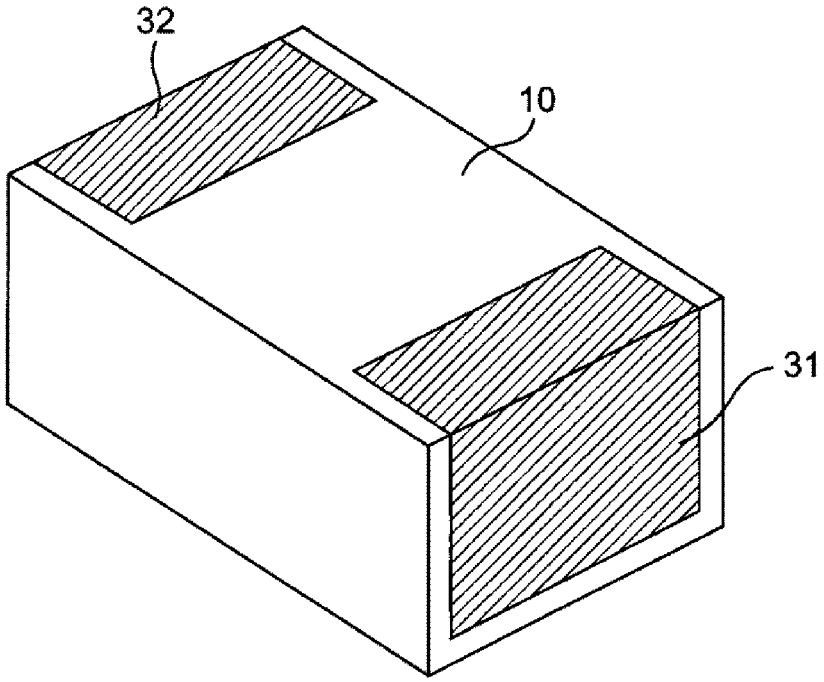
FIG. 2 is a perspective view of the electronic component illustrated in FIG. 1 without insulating layers.
Figure 3:
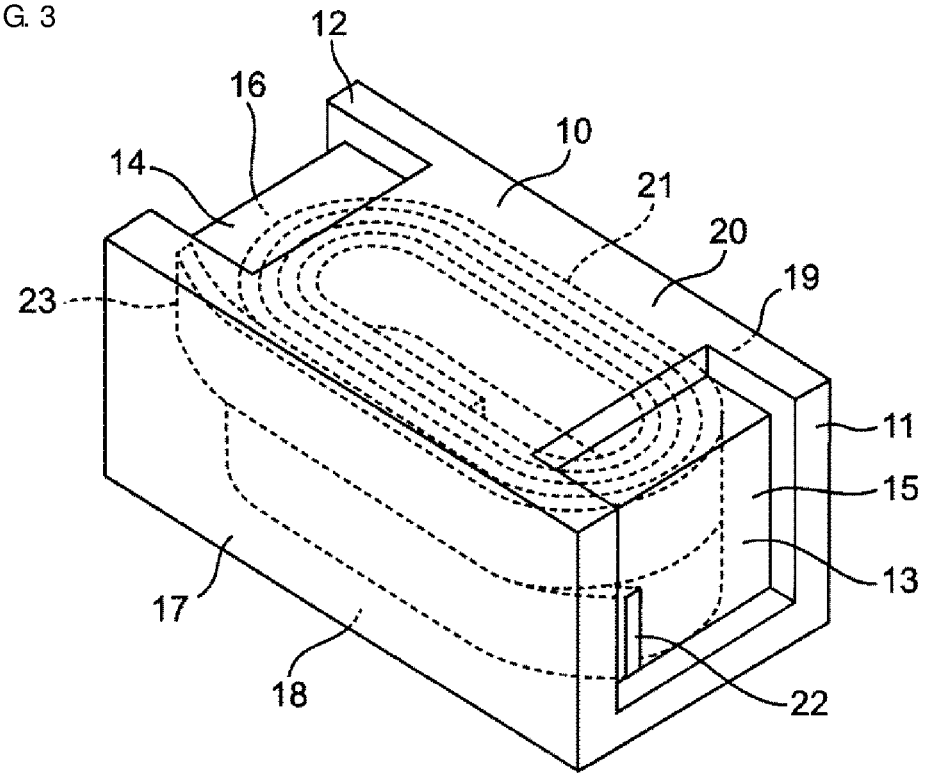
FIG. 3 is a perspective view of the electronic component illustrated in FIG. 1 without insulating layers and outer electrodes.
Figure 4:
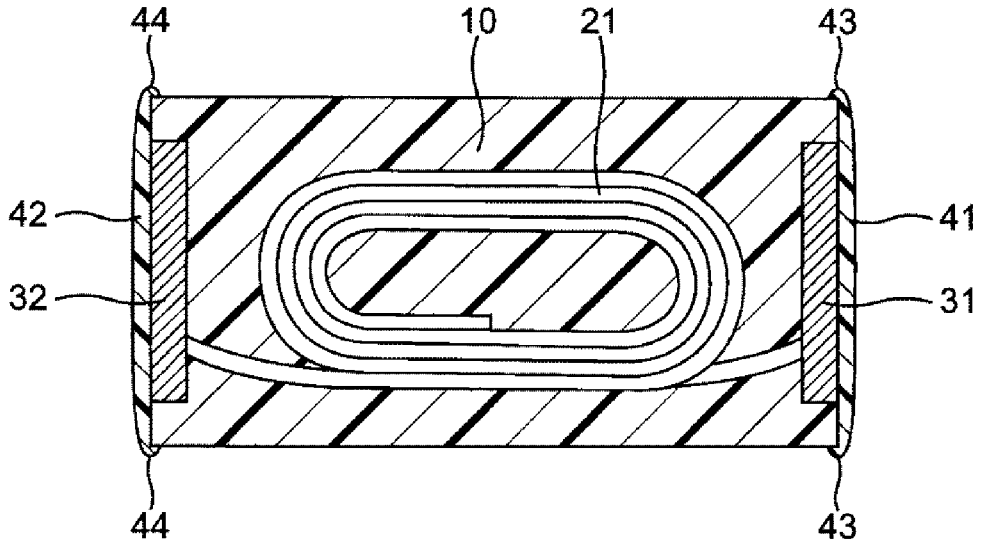
FIG. 4 is a cross-sectional view of the electronic component taken along the line a-a in FIG. 1.
Figure 5:
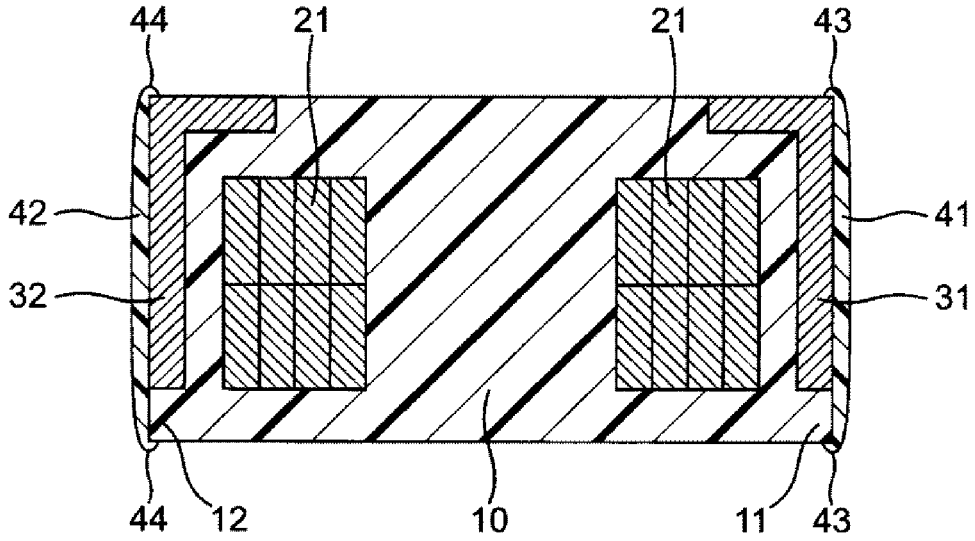
FIG. 5 is a cross-sectional view of the electronic component taken along the line b-b in FIG. 1.

FIG. 1 is a schematic perspective view of a coil component 1 according to the present embodiment. FIG. 2 is a schematic perspective view of the coil component 1 without insulating layers 41 and 42. FIG. 3 is a schematic perspective view of a magnetic body 10 (body) including a coil conductor 21 (inner conductor) in the coil component 1. FIG. 4 is a cross-sectional view of the electronic component 1 taken along the line a-a in FIG. 1. FIG. 5 is a cross-sectional view of the electronic component 1 taken along the line b-b in FIG. 1.

As illustrated in FIGS. 1 to 5, the coil component 1 according to the present embodiment has a generally rectangular parallelepiped shape. Roughly speaking, the coil component 1 includes the magnetic body 10, the coil conductor 21 embedded in the magnetic body 10, and outer electrodes 31 and 32. The magnetic body 10 has a generally rectangular parallelepiped shape, has two opposite end faces 15 and 16, and has a first side surface 17, a second side surface 18, a third side surface 19, and a fourth side surface 20 between the end faces 15 and 16. The magnetic body 10 includes a recessed portion 13 on the end face 15 and the fourth side surface 20 and includes a recessed portion 14 on the end face 16 and the fourth side surface 20. The outer electrode 31 is disposed in the recessed portion 13 and extends over the end face 15 and the fourth side surface 20. The outer electrode 32 is disposed in the recessed portion 14 and extends over the end face 16 and the fourth side surface 20. Thus, the outer electrodes 31 and 32 have a substantially L-shaped cross section. One end 22 of the coil conductor 21 is electrically connected to the outer electrode 31, and the other end 23 is electrically connected to the outer electrode 32. The outer electrodes 31 and 32 on the end faces 15 and 16 are covered with the insulating layers 41 and 42, respectively. The outer electrodes 31 and 32 are only exposed at one surface of the coil component 1, that is, the fourth side surface 20. Thus, the coil component 1 is a bottom electrode type coil component. In FIGS. 1 and 2, the outer electrodes 31 and 32 are hatched.

The coil conductor 21 is formed by winding a conducting wire containing an electrically conductive material. The electrically conductive material may be, but is not limited to, Au, Ag, Cu, Pd, or Ni. The electrically conductive materials may be used alone or in combination.

The shapes of the conducting wire and the coil conductor 21 are not limited to those illustrated in the figures and may be any shapes available for coil components. In the present embodiment, as illustrated in FIG. 3, the coil conductor 21 is wound as two layers such that the ends 22 and 23 are disposed outwardly. Thus, the coil conductor 21 is formed by winding a rectangular conducting wire outwardly in layers. The end 22 of the coil conductor 21 is exposed at the end face 15 of the magnetic body 10, and the other end 23 of the coil conductor 21 is exposed at the other end face 16 of the magnetic body 10.

The conducting wire of the coil conductor 21 may be covered with an insulating film. The conducting wire of the coil conductor 21 covered with an insulating film can ensure insulation between the coil conductor 21 and the magnetic body 10. The insulating film may be, but is not limited to, a film of a polyurethane resin, a polyester resin, an epoxy resin, or a polyamideimide resin.

The magnetic body 10 may be any body containing a magnetic material. The magnetic material may be a composite material of a metallic material and a resin material or a composite material of a ferrite material and a resin material. Preferably, the magnetic body 10 is formed of a composite material of a metallic material and a resin material.

The resin material may be, but is not limited to, an organic material, such as an epoxy resin, a phenolic resin, a polyester resin, a polyimide resin, or a polyolefin resin. The resin materials may be used alone or in combination.

The metallic material may be, but is not limited to, iron, cobalt, nickel, or gadolinium, or an alloy containing at least one thereof. Preferably, the metallic material is iron or an iron alloy. The iron alloy may be, but is not limited to, Fe—Si, Fe—Si—Cr, or Fe—Si—Al. The metallic materials may be used alone or in combination. The metallic material may contain at least one metal selected from palladium, silver, and copper, as well as the metal described above.

The metallic material is preferably a powder, that is, a metal powder. The metal powder may be a crystalline metal (or alloy) powder or an amorphous metal (or alloy) powder. The metal powder may be coated with an insulating substance. The insulating substance on the surface of the metal powder can increase the specific resistance of the magnetic body 10.

The metallic material content of the magnetic body 10 is preferably approximately 50% or more by volume, more preferably approximately 60% or more by volume, still more preferably approximately 70% or more by volume. A metallic material content in this range results in improved magnetic characteristics of a coil component according to an embodiment of the present disclosure. The metallic material content of the magnetic body 10 is preferably approximately 95% or less by volume, more preferably approximately 90% or less by volume, still more preferably approximately 87% or less by volume, still more preferably approximately 85% or less by volume. A metallic material content in this range results in an increased specific resistance of the magnetic body 10. In one embodiment, the metallic material content of the magnetic body 10 may preferably range from approximately 50% to 95% by volume, more preferably approximately 60% to 90% by volume, still more preferably approximately 70% to 87% by volume, still more preferably approximately 70% to 85% by volume.

The metal powder preferably has an average particle size of approximately 5 μm or more, more preferably approximately 10 μm or more. A metal powder having an average particle size of approximately 5 μm or more, particularly approximately 10 μm or more, is easy to treat. The metal powder preferably has an average particle size of approximately 100 μm or less, more preferably approximately 80 μm or less. A metal powder having an average particle size of approximately 100 μm or less, particularly approximately 80 μm or less, can have a high filling rate and improve the magnetic characteristics of the magnetic body 10. The term "average particle size", as used herein, refers to the average particle size D50 (the particle size at a cumulative percentage of 50% by volume). The average particle size D50 can be measured with a dynamic light scattering particle size analyzer (UPA manufactured by Nikkiso Co., Ltd.), for example. In one embodiment, the metal powder preferably has an average particle size in the range of approximately 5 to 100 μm, more preferably approximately 10 to 80 μm.

The ferrite material may be, but is not limited to, a ferrite material containing $Fe_2O_3$, NiO, ZnO, CuO, or $Mn_2O_3$, for example, Ni—Zn ferrite, Mn—Zn ferrite, Ni—Zn—Cu ferrite, Mn—Zn—Cu ferrite, or Mn—Zn—Ni ferrite.

The magnetic body 10 has the recessed portions 13 and 14. In the present embodiment, the recessed portions 13 and 14 are disposed in the regions in which the outer electrodes 31 and 32 are to be formed, that is, on the end faces 15 and 16 and a portion of the fourth side surface 20. The installation of an outer electrode in a recessed portion of a magnetic body can decrease the size of an electronic component with minimum degradation in the magnetic characteristics of the magnetic body.

The depth of the recessed portions 13 and 14 may be, but is not limited to, in the range of approximately 3 to 100 μm, preferably approximately 5 to 60 μm, more preferably approximately 10 to 50 μm, still more preferably approximately 20 to 50 μm, particularly preferably approximately 30 to 40 μm.

The phrase "the depth of the recessed portions", as used herein, refers to the average depth of each of the recessed portions 13 and 14 relative to the average position of the walls surrounding the recessed portions 13 and 14 (typically, the surface position of raised portions 11 and 12 of the magnetic body 10). For example, the depth of the recessed portions 13 and 14 can be determined by observing a cross section of the recessed portions 13 and 14 with a scanning electron microscope (SEM) and measuring the difference between the top position and the average bottom position in the image.

The recessed portions 13 and 14 may be formed by any method, for example, physical treatment or chemical treatment, such as laser irradiation, dicer cutting, or sandblasting. Preferably, the recessed portions 13 and 14 are formed by laser irradiation.

The outer electrodes 31 and 32 are disposed in the recessed portions 13 and 14 of the magnetic body 10. The outer electrodes 31 and 32 may be monolayer or multilayer.

The outer electrodes 31 and 32 are formed of an electrically conductive material, preferably at least one metallic material selected from Au, Ag, Pd, Ni, Sn, and Cu.

In the present embodiment, the outer electrodes 31 and 32 are disposed on the end faces 15 and 16, respectively, and extend to a portion of the fourth side surface 20. The outer electrode 31 is electrically connected to the end 22 of the coil conductor 21, and the outer electrode 32 is electrically connected to the end 23 of the coil conductor 21.

The outer electrodes 31 and 32 may completely fit into the recessed portions 13 and 14, may protrude from the recessed portions 13 and 14, or may extend from the recessed portions 13 and 14 to the raised portions 11 and 12. Preferably, the outer electrodes 31 and 32 substantially fit into the recessed portions 13 and 14.

The thickness of the outer electrodes 31 and 32 may be, but is not limited to, in the range of approximately 1 to 30 μm, preferably approximately 5 to 20 μm, more preferably approximately 5 to 15 μm. In a preferred embodiment, the thickness of the outer electrodes 31 and 32 is the same as the depth of the recessed portions 13 and 14 or is smaller than the depth of the recessed portions 13 and 14. In a more preferred embodiment, the thickness of the outer electrodes 31 and 32 is smaller than the depth of the recessed portions 13 and 14.

The outer electrodes 31 and 32 can be formed by any method, for example, plating or screen printing. Preferably, the outer electrodes 31 and 32 are formed by plating treatment.

In the present embodiment, the insulating layers 41 and 42 are disposed on the entire surfaces of the end faces 15 and 16 and cover the outer electrodes 31 and 32 on the end faces 15 and 16. The insulating layers 41 and 42 ensure the insulation of the coil component 1 from adjacent electronic components and enable fine pitch packaging.

The thickness of the insulating layers 41 and 42 may be, but is not limited to, in the range of approximately 1 to 100 μm, preferably approximately 5 to 50 μm, more preferably approximately 10 to 30 μm. The insulating layers 41 and 42 having a greater thickness can more reliably ensure insulation. The insulating layers 41 and 42 having a smaller thickness can result in a smaller size of the coil component.

The insulating layers 41 and 42 may be formed of an insulating resin material, such as an acrylic resin, an epoxy resin, or polyimide. The insulating layers 41 and 42 can be formed by any method, such as spraying or dipping.

Figure 6:
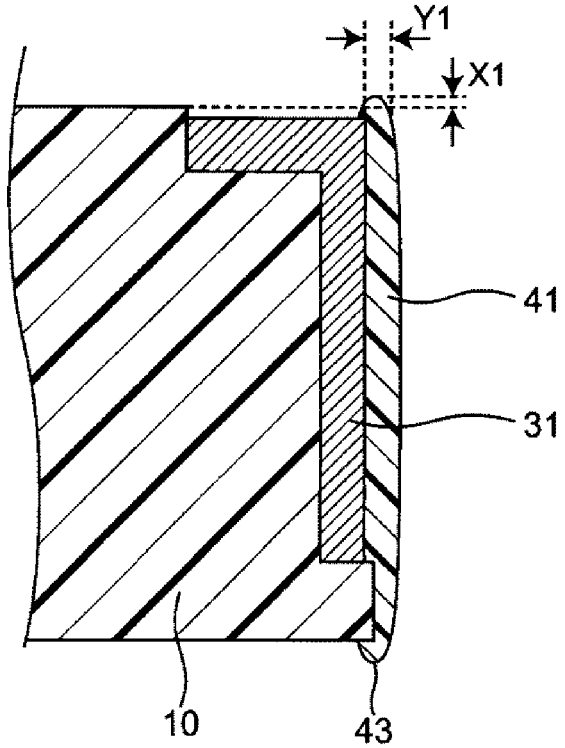
FIG. 6 is a cross-sectional view of an end portion of an electronic component according to an embodiment of the present disclosure.

When an insulating layer is formed on a surface of an electronic component, as described above, particularly when an insulating layer is formed by applying a fluid resin by dipping or spraying and then solidifying the fluid resin, the insulating layer may protrude outwardly from the surface on which the insulating layer is to be formed. For example, in the present embodiment, as illustrated in FIGS. 4 and 5, the insulating layers 41 and 42 have protrusions 43 and 44 at the edges of the end faces 15 and 16, respectively. An increase in the height X1 (see FIG. 6) of the protrusions of the insulating layers 41 and 42 on the component side of the coil component 1 (that is, the fourth side surface 20 on which a bottom electrode is disposed) may result in lifting and poor adhesion of the coil component 1 on the substrate. In the present disclosure, the thickness of an outer electrode in a recessed portion is smaller than the depth of the recessed portion to decrease the protrusion height X1. This can suppress the decrease in the adhesion of the coil component in packaging.

An insufficient thickness Y1 (see FIG. 6) of the insulating layers 41 and 42 on the outer electrodes 31 and 32 at the corners of the coil component 1 may result in insufficient insulation of the insulating layers 41 and 42 and may cause a plating defect on the surface of the insulating layers 41 and 42. A plating defect in fine pitch packaging of a coil component and other electronic components may disadvantageously cause a short circuit between the coil component and adjacent electronic components. In the present embodiment, the thickness of the outer electrodes 31 and 32 on the end faces 15 and 16 on which the insulating layers 41 and 42 are to be formed is smaller than the depth of the recessed portions 13 and 14. Thus, the raised portions 11 and 12 protrude from the end faces 15 and 16. The thickness of the insulating layers 41 and 42 on the outer electrodes 31 and 32 at the corners can therefore be increased. This can prevent plating defects at the corners. The difference between the thickness of the outer electrodes 31 and 32 and the depth of the recessed portions 13 and 14 may be, but is not limited to, in the range of approximately 1 to 50 μm, preferably approximately 5 to 30 μm, more preferably approximately 10 to 20 μm.

Figure 7:
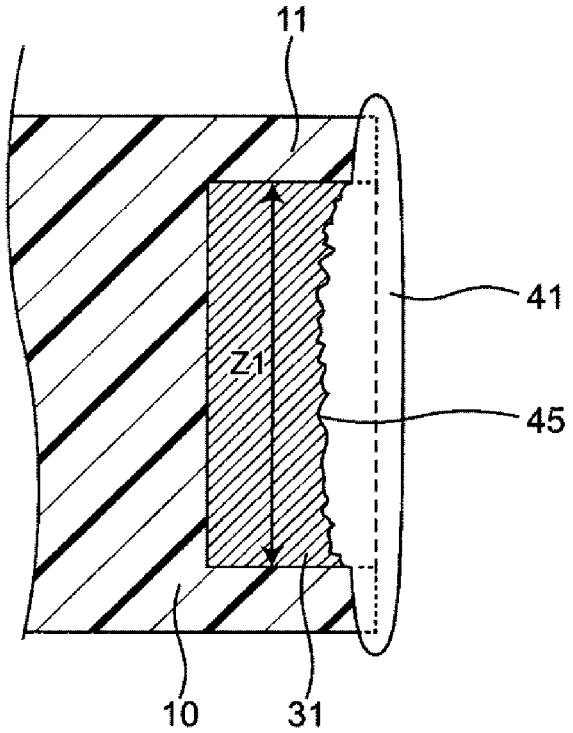
FIG. 7 is a plan view of a fourth side surface of an electronic component according to an embodiment of the present disclosure.

As illustrated in FIG. 7, the insulating layers 41 and 42 may have a folded portion 45 on the outer electrodes 31 and 32 at the edges thereof. In other words, the insulating layers 41 and 42 have wavy edges 45 on the outer electrodes 31 and 32, respectively. The folded portion 45 of the insulating layers 41 and 42 increases the peel resistance of the insulating layers 41 and 42.

In a preferred embodiment, the folded portion 45 has a rough boundary (the boundary between the folded portion 45 and the outer electrode 31 in FIG. 7) rather than a straight boundary. The length of the boundary between the folded portion 45 and the outer electrodes 31 and 32 (hereinafter referred to as the path length) may be at least approximately 1.2 times, preferably approximately 1.2 to 1.5 times, more preferably approximately 1.25 to 1.45 times, the length of the straight line between both ends of the folded portion 45 (Z1 in FIG. 7). In other words, the insulating layer 41 has a wavy edge on the outer electrode 31. The length of the wavy edge along the wave is preferably 1.2 to 1.5 times, more preferably 1.25 to 1.45 times, the width Z1 of the outer electrode 31. The path length can be measured in a SEM image of the boundary of the folded portion 45.

In the present disclosure, an insulating layer is not essential. In other words, an electronic component according to an embodiment of the present disclosure may or may not have an insulating layer. An electronic component according to an embodiment of the present disclosure preferably has an insulating layer.

A method for producing the coil component 1 will be described below.

First, the magnetic body 10 (body) including the coil conductor 21 (inner conductor) is produced. The coil conductors 21 are placed in a mold. A sheet of a composite material containing a metallic material and a resin material is then placed on the coil conductors 21 and is subjected to first press forming. At least part of the coil conductors 21 is embedded in the sheet by the first press forming. The coil conductors 21 are filled with the composite material.

The sheet including the coil conductors 21 after the first press forming is removed from the mold. Another sheet is then placed on a bare surface of the coil conductors 21 and is subjected to secondary pressing. Thus, a coil assembly substrate including the bodies 10 is produced. The two sheets are integrated by the secondary pressing and constitute the magnetic body 10 of the coil component 1.

The coil assembly substrate formed by the secondary press forming is then divided into the bodies 10 each including the coil conductor 21. The ends 22 and 23 of the coil conductor 21 are exposed at the opposite end faces 15 and 16 of each of the bodies 10.

The coil assembly substrate can be divided into the bodies 10 with a dicing blade, a laser apparatus, a dicer, a cutting tool, or a mold. In a preferred embodiment, the cut surfaces of the bodies 10 are subjected to barrel polishing.

The magnetic body 10 including the coil conductor 21 in the coil component 1 may be produced by any other method by which a magnetic body including a coil conductor can be produced. For example, a coil conductor paste and a metal powder paste are repeatedly applied by screen printing to form a block, and the block is divided into pieces and fired. Alternatively, a coil conductor may be embedded in a core of a composite material.

The portions of the magnetic body 10 on which the outer electrodes 31 and 32 are to be formed are then irradiated with a laser beam. Thus, the laser-irradiated portions of the magnetic body 10 are removed and form the recessed portions 13 and 14. Laser irradiation preferentially removes the resin material from the composite material of the magnetic body 10 and thereby leaves recessed and raised portions resulting from the metallic material on the surface of the recessed portions 13 and 14. The metallic material exposed at the surface of the magnetic body 10 may form a network structure.

The laser wavelength in the laser irradiation ranges from approximately 180 to 3000 nm, for example. The laser wavelength preferably ranges from approximately 532 to 1064 nm. Laser irradiation with a laser wavelength in this range can remove an insulating film from a coil conductor with less damage to a body and thereby increase the plating rate. The laser wavelength is determined in consideration of damage to a body and a reduction in processing time. The laser radiation energy is preferably approximately 0.20 $J/mm^2$ or more, more preferably approximately 0.35 $J/mm^2$ or more, still more preferably approximately 0.45 $J/mm^2$ or more, still more preferably approximately 0.50 $J/mm^2$ or more, for example, approximately 0.60 $J/mm^2$ or more. Laser radiation energy in this range results in more efficient removal of an insulating film and a resin material of a magnetic body and better formation of a network structure of a metallic material of a magnetic body. The laser radiation energy may preferably be approximately 3.0 $J/mm^2$ or less, more preferably approximately 2.0 $J/mm^2$ or less, still more preferably approximately 1.5 $J/mm^2$ or less, for example, approximately 1.0 $J/mm^2$ or less. Laser radiation energy in this range can have less damage to a body. In one embodiment, the laser radiation energy may preferably range from approximately 0.20 to 3.0 $J/mm^2$, more preferably approximately 0.35 to 2.0 $J/mm^2$, still more preferably approximately 0.45 to 1.5 $J/mm^2$, still more preferably approximately 0.50 to 1.0 $J/mm^2$, particularly preferably approximately 0.60 to 1.0 $J/mm^2$.

The outer electrodes 31 and 32 are then formed in the recessed portions 13 and 14 by plating treatment, preferably electroplating treatment. The ends 22 and 23 of the coil conductor 21 are electrically connected to the outer electrodes 31 and 32, respectively, by the plating treatment.

The plating metal may be of any type, for example, Au, Ag, Pd, Ni, Sn, or Cu, preferably Pd, Ag, or Cu. In the case where the outer electrodes 31 and 32 are multilayer, for example, a Ni plating layer and a Sn plating layer are preferably formed on the plating layer. The plating method is preferably, but not limited to, barrel plating.

A resin is applied to the end faces 15 and 16 by spraying or dipping and is solidified to form the insulating layers 41 and 42. The coil component 1 according to the present embodiment is produced in this way.

Although the coil components and the methods for producing the coil components according to the embodiments of the present disclosure are described above, the present disclosure is not limited to these embodiments, and these embodiments may be modified without departing from the gist of the present disclosure.

In an electronic component according to an embodiment of the present disclosure, a recessed portion is continuously disposed on an end face and at least one side surface of a body, and an outer electrode is continuously disposed in the recessed portion on the end face and the at least one side surface of the body. In this embodiment, when the recessed portion and the outer electrode are continuously disposed on the end face and one side surface, the outer electrode substantially has a L shape, as illustrated in FIG. 5. When the recessed portion and the outer electrode are continuously disposed on the end face and two opposite side surfaces, the outer electrode substantially has a U shape. When the recessed portion and the outer electrode are continuously disposed on the end face and adjacent four side surfaces, the outer electrode is an electrode with five faces.

In the embodiment described above, preferably, the electronic component further includes an insulating layer. The insulating layer may be disposed on an end face, a first side surface, a second side surface, a third side surface, or a fourth side surface. In a preferred embodiment, the insulating layer covers an outer electrode on an end face. For substantially L-shaped outer electrodes, the end faces can be covered with an insulating layer to produce an electronic component of a bottom electrode type. For substantially U-shaped outer electrodes, the end faces can be covered with an insulating layer to produce an electronic component with top and bottom electrodes. For outer electrodes each having five faces, the end faces can be covered with an insulating layer to produce an electronic component with top, bottom, left, and right electrodes.

In an electronic component according to a preferred embodiment of the present disclosure, a recessed portion is continuously disposed on an end face and one side surface of a body, an outer electrode is disposed in the entire recessed portion, and an insulating layer covers the outer electrode on the end face.

In one embodiment, the thickness of the outer electrode is smaller than the depth of the recessed portion. The difference between the thickness of the outer electrode and the depth of the recessed portion may be, but is not limited to, approximately 1 μm or more, preferably approximately 5 μm or more, more preferably approximately 10 μm or more. The difference between the thickness of the outer electrode and the depth of the recessed portion may be, but is not limited to, approximately 80 μm or less, preferably approximately 30 μm or less, more preferably approximately 20 μm or less.

In the embodiment described above, preferably, the electronic component further includes an insulating layer on the outer electrode. The insulating layer may be only disposed on the outer electrode or may be disposed on the outer electrode in the recessed portion and extend to a raised portion. Preferably, the insulating layer is disposed on the outer electrode in the recessed portion and extends to the raised portion in such a manner as to cover the entire surface on which the insulating layer is formed.

An electronic component according to an embodiment of the present disclosure has an insulation film on an outer surface of a body. Preferably, the insulation film covers outer electrodes and the entire outer surface of the body not covered with an insulating layer. The insulation film can be formed by spraying or dipping, for example.

An electronic component according to an embodiment of the present disclosure is a coil component, in which a coil conductor is disposed such that the central axis of the coil conductor is parallel to the end faces.

An electronic component according to an embodiment of the present disclosure is a capacitor.

In the embodiment described above, the body is a dielectric body. The dielectric body is preferably composed of a ceramic material. The ceramic material may be any ceramic material for use in electronic components, for example, $BaTiO_3$, $CaTiO_3$, $SrTiO_3$, $CaZrO_3$, $(BaSr)TiO_3$, $Ba(ZrTi)O_3$, or $(BiZn)Nb_2O_7$.

An electronic component according to an embodiment of the present disclosure may preferably have a length of approximately 2.0 mm or less, more preferably approximately 1.6 mm or less, still more preferably approximately 1.0 mm or less, still more preferably approximately 0.6 mm or less, particularly preferably approximately 0.4 mm or less. An electronic component according to an embodiment of the present disclosure may preferably have a width of approximately 1.2 mm or less, more preferably approximately 0.8 mm or less, still more preferably approximately 0.5 mm or less, still more preferably approximately 0.3 mm or less, particularly preferably approximately 0.2 mm or less. An electronic component according to a preferred embodiment of the present disclosure may preferably have a size of approximately 2.0 mm or less×approximately 1.2 mm or less, more preferably approximately 1.6 mm or less×approximately 0.8 mm or less, still more preferably approximately 1.0 mm or less×approximately 0.5 mm or less, still more preferably approximately 0.6 mm or less× approximately 0.3 mm or less, still more preferably approximately 0.4 mm or less×approximately 0.2 mm or less (length×width). An electronic component according to an embodiment of the present disclosure may preferably have a height of approximately 1.2 mm or less, more preferably approximately 1.0 mm or less, still more preferably approximately 0.6 mm or less, still more preferably approximately 0.2 mm or less.

EXAMPLES

Example 1

An Fe—Si—Cr alloy powder was prepared as a metal powder, and a composite sheet containing an epoxy resin was prepared as a resin material. α-coiled conductors (coil conductors formed by winding a rectangular conducting wire outwardly in two layers) made of copper were prepared.

The α-coiled conductors were then placed on a mold. The composite sheet was placed on the α-coiled conductors and was pressed for approximately 30 minutes at a pressure of approximately 5 MPa and at a temperature of approximately 150° C.

The composite sheet combined with the coil conductors was then removed from the mold. Another composite sheet was placed on the surface at which the coil conductors were exposed, and was pressed for approximately 30 minutes at a pressure of approximately 5 MPa and at a temperature of approximately 150° C. to form a coil assembly substrate including the coil conductors.

The coil assembly substrate was divided into bodies with a dicing blade. The bodies were subjected to barrel polishing. The ends of the coil conductors were exposed at the opposite side surfaces (end faces) of the bodies.

The regions of the body in which outer electrodes were to be formed (corresponding to the recessed portions 13 and 14 in FIG. 3) were then irradiated with a laser beam. The laser was a $YVO_4$ laser (wavelength: approximately 532 nm), and the radiation energy was approximately 0.086 mJ/shot (approximately 0.45 J/mm$^2$).

Cu plating was then performed for approximately 180 minutes with a barrel electroplating apparatus at a current value of approximately 15 A and at a temperature of approximately 55° C. to form outer electrodes on the laser-irradiated surfaces.

An insulating layer of an epoxy resin was then formed by dipping on the end faces of the body on which the outer electrodes were disposed. Thus, a coil component according to an embodiment of the present disclosure was produced.

Example 2

A coil component was produced in the same manner as in Example 1 except that the laser radiation energy was approximately 0.021 mJ/shot (approximately 0.10 J/mm$^2$).

Comparative Example 1

A coil component was produced in the same manner as in Example 1, except that the recessed portions were not formed, a seed layer was formed by applying a Pd solution to the regions of the magnetic body in which the outer electrodes were to be formed, and then Cu plating was performed.

Evaluation

Path Length of Folded Portion in Insulating Layer

A folded portion in the (five) coil components produced in each of Example 1 and Comparative Example 1 was observed with a scanning electron microscope (SEM). The average ratio of the path length to the length of the straight line between both ends of the folded portion (path length ratio) was calculated in the five coil components. Table 1 shows the results.

Plating Defects

A corner of the (100) coil components of each of Examples 1 and 2 and Comparative Example 1 was checked for plating defects with the SEM. Plating defects were observed in approximately 3% of the coil components according to Examples 1 and 2 and in approximately 70% of the coil components according to Comparative Example 1.

Cross-Sectional Shape of Periphery of Outer Electrode

The (five) coil components produced in Examples 1 and 2 were stood such that the LT-surfaces were exposed, and were enclosed with a resin. The LT-surfaces were polished with a polisher up to almost the center of an end of the coil conductor. The cross-sectional shape of the periphery of an outer electrode was observed with the SEM. The depth of a recessed portion and the thickness of the outer electrode were measured. Table 1 shows the results.

TABLE 1

| | Path length ratio | Depth of recessed portion | Thickness of electrode | Plating defect |
|---|---|---|---|---|
| Example 1 | 1.37 | 40.8 μm | 10.3 μm | None |
| Example 2 | — | 30.4 μm | 7.8 μm | None |
| Comparative example 1 | 1.03 | — | — | Observed |

As described above, plating defects were few in Examples 1 and 2, in which the recessed portions were formed by laser irradiation, and the outer electrodes were formed in the recessed portions. The path length ratio in Example 1 was 1.37, and the folded portion entered into the outer electrode. By contrast, in Comparative Example 1, in which no recessed portion was formed, plating defects were noticeable, and the path length ratio was small, indicating that the boundary between the folded portion and the outer electrode was substantially a straight line.

Due to its small size and high performance, an electronic component according to an embodiment of the present disclosure can be widely used in various applications.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. An electronic component comprising:

a body having a recessed portion;

an inner conductor embedded in the body; and an outer electrode electrically connected to the inner conductor, and at least part of the outer electrode is disposed in the recessed portion of the body, wherein the recessed portion is continuously disposed on an end face of the body and at least one side surface of the body such that the recessed portion includes a first part formed in the end face and a second part that extends from a bottom surface of the first part along the at least one side surface towards an other end face of the body that is opposite the end face.

2. The electronic component according to claim 1, further comprising an insulating layer configured such that at least part of the outer electrode is covered with the insulating layer.

3. The electronic component according to claim 2, wherein:

the outer electrode is continuously disposed in the recessed portion on the end face and the at least one side surface of the body; and the insulating layer covers the outer electrode on the end face.

4. The electronic component according to claim 3, wherein a path length of a boundary of a folded portion of the insulating layer is 1.2 times or more a length of a straight line between both ends of the path.

5. The electronic component according to claim 1, wherein the recessed portion has a depth in the range of 3 to 100 μm.

6. The electronic component according to claim 3, wherein the recessed portion has a depth in the range of 3 to 100 μm.

7. The electronic component according to claim 1, wherein the recessed portion is formed by laser irradiation.

8. The electronic component according to claim 1, wherein the inner conductor is a coil conductor, and the body is a magnetic body.

9. The electronic component according to claim 8, wherein the magnetic body is formed of a composite material containing a metallic material and a resin material.

10. The electronic component according to claim 1, wherein:

the body has an additional recessed portion; and the electronic component further comprises an additional outer electrode connected to the inner conductor, and at least part of the additional outer electrode is disposed in the additional recessed portion of the body.

11. The electronic component according to claim 10, wherein:

one end of the coil conductor is electrically connected to the outer electrode, and an other end of the coil conductor is electrically connected to the additional outer electrode.

12. The electronic component according to claim 2, wherein the insulating layer includes a protrusion.

13. The electronic component according to claim 12, wherein the protrusion extends from a portion of the outer electrode that is disposed in the at least one side surface of the body.

14. The electronic component according to claim 12, wherein:

the protrusion extends outwardly in a direction away from the at least one side surface.

15. The electronic component according to claim 14, wherein:

the insulating layer includes an additional protrusion extending outwardly in a direction away from another side surface of the body opposite to the at least one side surface.

16. The electronic component according to claim 1, wherein the recessed portion is L-shaped.

17. The electronic component according to claim 1, wherein the recessed portion is U-shaped.

18. The electronic component according to claim 1, wherein the recessed portion is continuously disposed on the end face and each side surface of the body.

19. The electronic component according to claim 1, wherein a portion of the body protrudes between one end of the recessed portion and an other end of the recessed portion.

* * * * *